US012188687B2

(12) United States Patent
Ding et al.

(10) Patent No.: US 12,188,687 B2
(45) Date of Patent: Jan. 7, 2025

(54) CONTROL DEVICE FOR EXPANSION TANK AND WATER HEATER

(71) Applicant: Kohler (China) Investment Co., Ltd., Shanghai (CN)

(72) Inventors: Yongsheng Ding, Shanghai (CN); Jie Zhang, Shanghai (CN)

(73) Assignee: Kohler (China) Investment Co., Ltd., Shanghai (CN)

( * ) Notice: Subject to any disclaimer, the term of this patent is extended or adjusted under 35 U.S.C. 154(b) by 14 days.

(21) Appl. No.: 18/048,502

(22) Filed: Oct. 21, 2022

(65) Prior Publication Data

US 2023/0129689 A1 Apr. 27, 2023

(30) Foreign Application Priority Data

Oct. 21, 2021 (CN) ..... 202122544008.2

(51) Int. Cl.

| | |
|---|---|
| ***F24D 3/10*** | (2006.01) |
| ***F24H 1/18*** | (2022.01) |
| ***F24H 15/238*** | (2022.01) |
| ***F24H 15/305*** | (2022.01) |

(52) U.S. Cl.

CPC ..... *F24H 1/188* (2013.01); *F24H 15/238* (2022.01); *F24H 15/305* (2022.01)

(58) Field of Classification Search

CPC ..... F24D 3/1008; F24D 3/10; F24D 3/1025; F16L 55/05; F24H 1/188; F24H 15/238; F24H 15/305

See application file for complete search history.

(56) References Cited

U.S. PATENT DOCUMENTS 2,889,116 A * 6/1959 MacCracken ..... F24D 3/08 237/19
8,083,104 B2 * 12/2011 Roetker ..... B67D 1/0884 62/390

FOREIGN PATENT DOCUMENTS

| | | | | |
|---|---|---|---|---|
| CN | 201191084 Y | * | 2/2009 | |
| CN | 108006957 A | * | 5/2018 | |
| GB | 2285854 A | * | 7/1995 | ..... F16L 41/08 |
| KR | 20090129828 A | * | 12/2009 | |
| KR | 20170075235 A | * | 7/2017 | |
| WO | WO-2017139851 A1 | * | 8/2017 | ..... F24H 1/102 |
| WO | WO-2018124651 A1 | * | 7/2018 | ..... F24D 19/10 |

* cited by examiner

*Primary Examiner* — Gregory A Wilson
(74) *Attorney, Agent, or Firm* — Husch Blackwell LLP

(57) ABSTRACT

An expansion tank control device and a water heater and expansion tank including the expansion tank control device. The device may include a water flow sensor arranged in a water inlet waterway of a water heater to detect water flow in the water inlet waterway. The device can further include a controller outputting a driving electric signal after receiving a first electric signal output by the water flow sensor, and a reset electric signal after receiving a second electric signal output by the water flow sensor. The expansion tank can include an electric driving part arranged on a shell of the expansion tank, and a push plate on a driving end of the part, a controlled end of the electric driving part driving the push plate to move toward the expansion tank after receiving the driving electric signal or away from the expansion tank after receiving the reset electric signal.

22 Claims, 3 Drawing Sheets

CONTROL DEVICE FOR EXPANSION TANK AND WATER HEATER

PRIORITY CLAIM

This application claims priority to Chinese Utility Model Patent Application No. 202122544008.2, entitled "Control Device for Expansion Tank and Water Heater" and filed Oct. 21, 2021, the entirety of which is hereby incorporated by reference.

TECHNICAL FIELD

The present disclosure relates to hot water distributors. More specifically, to a control device for an expansion tank and a water heater comprising same.

BACKGROUND

A water heater usually includes a heating tank and an expansion tank. The expansion tank is a safety device used to absorb thermal expansion and alleviate the pressure caused while water in the heating tank generates expansion so as to be filled with hot water. When a hot water distributor is working and a hot water faucet is turned on to make the hot water flow out of the heating tank, it is necessary to discharge the hot water in the expansion tank to release expansion space.

Most expansion tanks use a venturi pipe to generate a negative pressure difference at the narrowest part of the pipe during the water flow process, thereby generating an adsorption force, and the hot water in the expansion tank is sucked out by the adsorption force. The negative pressure difference of the venturi tube is largely affected by the water flow pressure within the venturi tube. For that reason, the expansion tank cannot work properly once the negative pressure fails to be formed in the pipe due to limited water flow pressure or other factors. If the expansion tank cannot release the expansion space in time, the heating tank is unable to accommodate the extra hot water due to expansion when performing a heating function, resulting in continuous dripping of water from the faucet.

Accordingly, there is a need to continue to improve functionality and features of faucets, and more specifically the hot water heating capabilities of faucets while minimizing dripping.

SUMMARY

The present disclosure relates to hot water distributors and expansion tanks that utilize a venturi pipe.

An expansion control device may include a water flow sensor, a water inlet, a water heater, a controller, and an electric driving part. The water flow sensor may be arranged in the water inlet waterway. The water flow sensor may send out a first electronic signal after detecting the water flow in the water inlet. A second electronic signal may be sent after detecting that no water flow exists in the water inlet waterway.

In one embodiment, an input end of the controller may be connected to an output end of the water flow sensor. The controller then outputs a driving signal after receiving the first electronic signal output by the water flow sensor, and outputs a reset electric signal after receiving the second electric signal output by the water flow sensor.

In another embodiment, the electric driving part may be arranged on a shell of the expansion tank. A controlled end of the electric driving part may then be connected with an output end of the controller, and a driving end of the electric driving part may have a push plate. The controlled end of the electric driving part then drives the push plate to move in a direction close to the expansion tank after receiving the driving electric signal, or in a direction away from the expansion tank after receiving the reset electric signal.

In some embodiments, the expansion tank control device further may include a fixed seat arranged on the shell of the expansion tank, with the electric driving part arranged on the fixed seat. A hole may be formed on the fixed seat, and the driving end of the electric driving part may move along through the hole.

In some embodiments of the expansion tank control device, the electric driving part may have an electromagnet. A controlled end of the electromagnet may be powered on after receiving the driving electric signal, and a driving end of the electromagnet moves towards to the expansion tank. When the controlled end of the electromagnet is powered off after receiving the reset electric signal, the driving end of the electromagnet may move away from the expansion tank.

In some embodiments of the expansion tank control device, the electric driving part may include a motor, a screw rod, and a nut. The nut may be arranged in the hole, and the push plate may be connected with the nut. One end of the screw rod may be connected with an output shaft of the motor, and the other end of the screw rod is connected with the nut. Once the driving electric signal is received, a controlled end of the motor drives the screw rod to rotate in a first direction, and the nut moves along the hole in the direction towards the expansion tank. After receiving the reset electric signal, the controlled end of the motor may drive the screw rod to rotate in a second direction, and the nut moves along the hole in the direction away from the expansion tank.

In some embodiments of the expansion tank control device, a chute may be formed in the hole, and an outer wall of the nut is formed with a rib matched with the chute.

In another embodiment, the expansion tank control may have a fixing piece, where the fixed seat has a pair of fixing lugs, and fixing holes are formed on the fixing lugs. A connecting hole may be formed on a shell of the electric driving part, and the fixing piece may penetrate through the connecting hole and the fixing hole in turn to fix the electric driving part.

In another embodiment, a venturi pipe may be arranged on the water inlet waterway of the water heater and located at an opening of the expansion tank. The venturi pipe may be arranged at a downstream position of the waterway of the water flow sensor and may provide a supporting force for the water flow sensor. A water heater may be used, and may include the expansion tank control device described in any one of the above embodiments.

Embodiments of the present disclosure can have one or more the following technical effects:

According to embodiments of the disclosure directed to the expansion tank control device and the water heater, the water flow sensor is used to detect whether a faucet is turned on. When the faucet is turned on, water flow can be detected in the water inlet waterway of the water heater, the controller controls the electric driving part to drive the push plate to move in the direction close to the expansion tank so as to push out the water stored in the expansion tank. When the faucet is turned off, no water flow is detected in the water inlet waterway of the water heater, the controller controls the electric driving part to drive the push plate to move in the direction far away from the expansion tank so as to suck portion of the water in the heating tank into the expansion tank and form a cavity at the top of the heating tank to absorb the volume expansion of the water in the heating process and prevent the hot water from flowing out from a water outlet of the faucet. According to embodiments, the functions of the expansion tank are realized by the electric driving part, which is not influenced by a water pressure, and is more reliable.

The above summary is not intended to describe each illustrated embodiment or every implementation of the subject matter hereof. The figures and the detailed description that follow more particularly exemplify various embodiments.

BRIEF DESCRIPTION OF THE DRAWINGS

Subject matter hereof may be more completely understood in consideration of the following detailed description of various embodiments in connection with the accompanying figures, in which.

Figure 1:
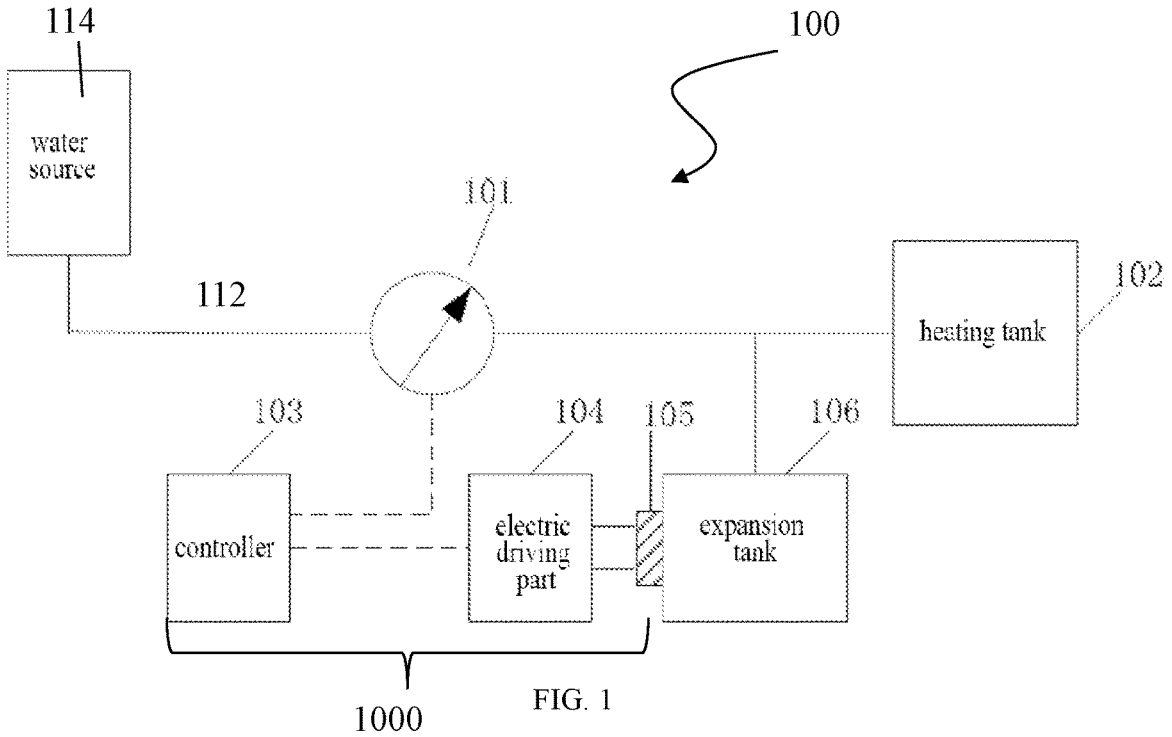
FIG. 1 is a block diagram of an expansion tank control device according to an embodiment of the disclosure.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION OF THE DRAWINGS

The present disclosure relates to an expansion control device. The expansion control device may include and a water heater comprising the same. The expansion control device may further include a water flow sensor, a water inlet, a water heater, a controller, and an electric driving part. The water flow sensor may be arranged in the water inlet waterway. The technical solutions of embodiments of the application will be described clearly and completely with reference to the accompanying drawings. Obviously, the described embodiments are some but not all of the embodiments of the application. Based on the embodiments of the application, all other embodiments obtained by those having ordinary skills in the art without going through any creative work shall fall within the scope of protection of the application.

In the description of the application, it should be noted that, the orientation or positional relationships indicated by the terms "center", "up", "down", "left", "right", "vertical", "horizontal", "inside", "outside" and the like are orientation or positional relationships based on the accompanying drawings, which are only for convenience and simplification of the description of this application, but are not intended to indicate or imply that the indicated device or element must have a specific orientation, be constructed and operated in a specific orientation, and thus, cannot be understood as a limitation to the application. Moreover, the terms "first", "second" and "third" are used for descriptive purposes only and cannot be understood as indicating or implying relative importance.

In the description of the application, it should be noted that unless expressly stipulated and defined otherwise, terms such as "installation", "connected" and "connection", etc., should be understood broadly, for example, the connection may be fixed connection, or detachable connection or integral connection; may be direct connection, may also be indirect connection through an intermediate medium, and may also be internal communication of two elements. The specific meaning of the above terms in the application can be understood by those having ordinary skills in the art according to a specific case.

Figure 2:
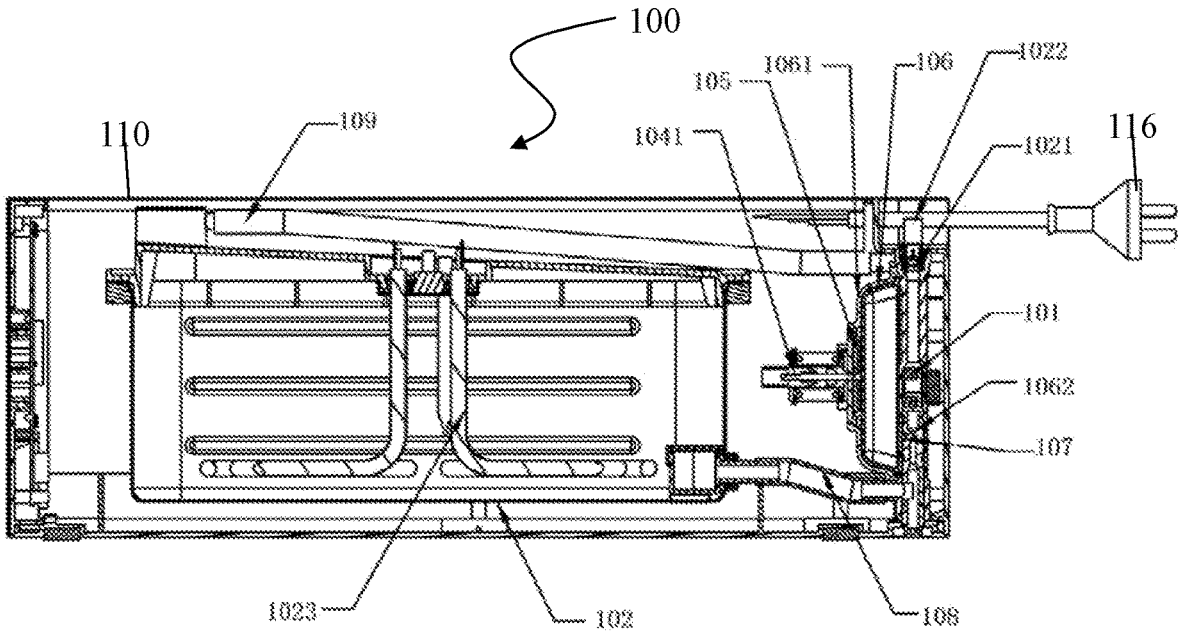
FIG. 2 is a top assembled view of a water heater according to an embodiment of the disclosure.
Figure 3:
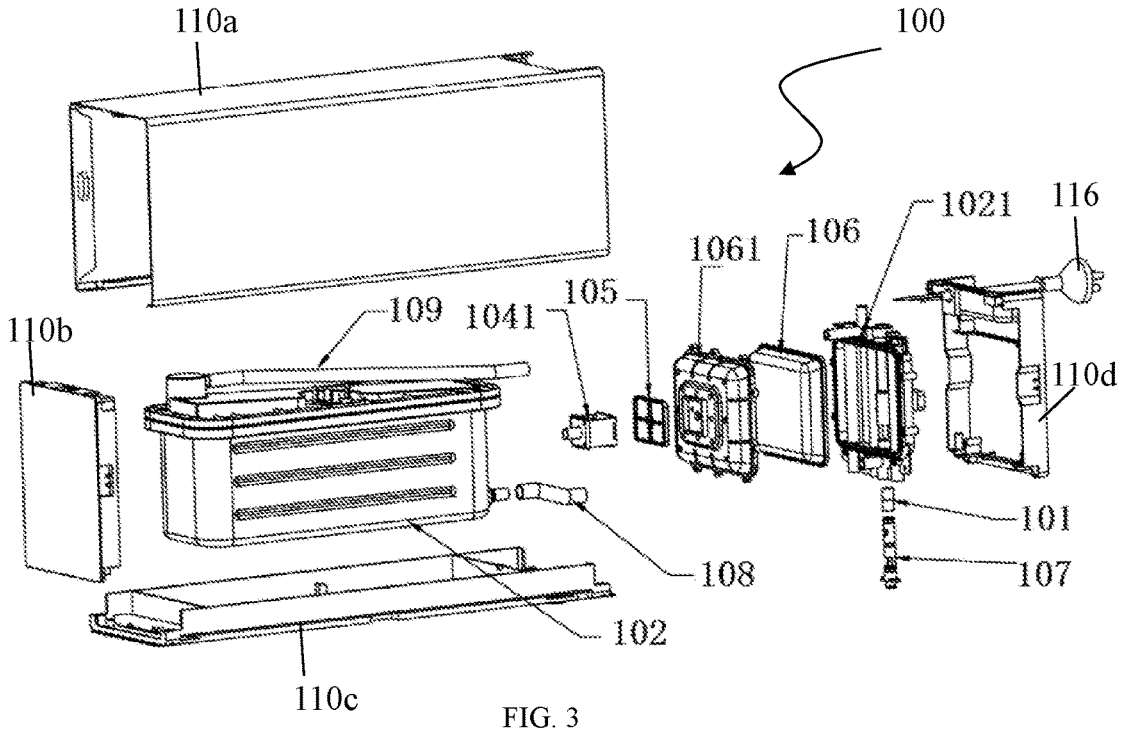
FIG. 3 is an exploded view of the expansion tank control device according to an embodiment of the disclosure.

According to one embodiment of the present disclosure, an expansion tank control device 1000 may be used in a water heater assembly 100, as shown in FIG. 1 to FIG. 3. The expansion tank control device 1000 may comprise a water flow sensor 101, a controller 103, an electric driving part 104, and a push plate 105, all arranged within in a housing 110 with the remaining components of the water heater assembly 100. The housing 110 may include a single piece, or one or more connecting sidewalls 110*a*-110*d*, and optionally an electric plug 116 or other power source, such as a battery pack. The water flow sensor 101 may be arranged in a water inlet waterway 112 of the water heater (as shown in the figure, the water flow sensor 101 is arranged between a water source 114 and a heating tank 102), and the water flow sensor 101 may comprise, but is not limited to, a flow sensor, a water pressure sensor or a conductivity sensor. In embodiments, the water flow sensor 101 sends out a first electric signal after detecting a water flow in the water inlet waterway 112, and the water flow sensor 101 sends out a second electric signal after detecting that no water flow exists in the water inlet waterway 112.

In a non-limiting example, the first electric signal may be a high level signal and the second electric signal may be a low level signal. An input end of the controller 103 is connected with an output end of the water flow sensor 101. The controller 103 outputs a driving electric signal after receiving the first electric signal output by the water flow sensor 101, and outputs a reset electric signal after receiving the second electric signal output by the water flow sensor 101.

The electric driving part 104 may be arranged on a shell 1061 of the expansion tank 106. A controlled end of the electric driving part 104 is connected with an output end of the controller 103, and a driving end of the electric driving part 104 is provided with a push plate 105. The controlled end of the electric driving part 104 drives the push plate 105 to move in a direction towards the expansion tank 106 after receiving the driving electric signal, and the controlled end of the electric driving part 104 drives the push plate 105 to move in a direction away from the expansion tank 106 after receiving the reset electric signal.

Specifically, with reference to FIG. 2 and FIG. 3, when a faucet is turned on, the water inlet waterway 112 between the water source 114 and the water heater is opened, cold water enters the water heater through a water inlet 1021, and the water flow sensor 101 detects the water flow and outputs a first electric signal to the controller 103. The controller 103 then controls the electric driving part 104 to move, and the driving end of the electric driving part 104 extends and moves to the right, driving the push plate 105 to push and press the expansion tank 106. The expansion tank 106 may be made of silica gel, or another suitable material. After being pushed by the push plate 105, the water stored in the expansion tank is discharged through a drain pipe 107, and the discharged water enters the heating tank 102 through a water inlet hose 108. The hot water in the heating tank 102 is discharged to a water outlet 1022 through a drain hose 109, and the water outlet 1022 is communicated with the faucet (not shown), and thus the faucet discharges the hot water.

In another embodiment, when the faucet is turned off, the water inlet waterway 112 between the water source 114 and the water heater 100 is closed, the water flow sensor 101 detects no water flow and then outputs a second electric signal to the controller 103, then the controller 103 controls the electric driving part 104 to move, and a driving section of the electric driving part 104 withdraws and moves to the left, driving the push plate 105 to be far away from the expansion tank 106. The water in the heating tank 102 is stored in the expansion tank 106 through the water inlet hose 108 and the drain pipe 107 under pressure. In this case, a part of the cavity is released from the top of the heating tank 102. When an electric heater 1023 executes a heating operation, the cavity may be used to absorb the expansion of the water in the heating tank 102 during the heating process and prevent the water in the heating tank 102 from overflowing from the faucet. In the structure shown in the figure, the water flow sensor 101 is arranged at a front end of the expansion tank 106, which can further avoid the occurrence of a detection signal from the water flow sensor 101 in the process of releasing the water in the heating tank 102 to the expansion tank 106 when the faucet is turned off, thereby improving the reliability of the expansion tank 106.

In the foregoing embodiment, the electric driving part 104 may be realized by an electric cylinder, an electric worm gear or the like, i.e., a member capable of extending or retracting the driving end. The controller 103 may be realized directly by a control module of the water heater itself.

According to the embodiment above, the water flow sensor 101 is used to detect whether the faucet is turned on. When the faucet is turned on, water flow can be detected in the water inlet waterway 112 of the water heater 100, and the controller 103 controls the electric driving part 104 to drive the push plate 105 to move in the direction towards to the expansion tank 106 so as to push out the water stored in the expansion tank 106. When the faucet is turned off, no water flow is detected in the water inlet waterway of the water heater, and the controller 103 controls the electric driving part 104 to drive the push plate 105 to move in the direction away from the expansion tank 106 so as to suck part of the water in the heating tank 102 into the expansion tank 106 and form a cavity at the top of the heating tank 102. This helps to absorb the volume expansion of the water in the heating process and prevent the hot water from flowing out from a water outlet of the faucet. In the above solution, the functions of the expansion tank 106 are realized by the electric driving part 104, which is not influenced by a water pressure, and is more reliable.

According to FIG. 2 and FIG. 3, the expansion tank control device 1000 further comprises a venturi pipe 1062, which is arranged on the water inlet waterway of the water heater and located at an outlet of the expansion tank 106, and may be connected with the drain pipe 107 of the heating tank 102. In one embodiment, the venturi pipe 1062 is arranged at a downstream position of the waterway of the water flow sensor 101 to provide a supporting force for the water flow sensor 101. The venturi tube 1062 may have a jet orifice structure. When cold water passes through the venturi tube 1062, a negative pressure is generated at the drain pipe 107. Through the negative pressure of the venturi effect and the driving effect of the electric driving part 104, the drainage effect of the expansion tank 106 may reduce a thrust of the electric driving part 104, improving the control effect and reducing the cost.

Further, the expansion tank control device 1000 may comprise a fixed seat arranged on the shell 1061 of the expansion tank 106, and the electric driving part 104 is arranged on the fixed seat. The shell 1061 of the expansion tank 106 may be made of a rigid material, and the fixed seat can also be made of a rigid material. The internal members of the water heater 100 may all be made of waterproof and non-oxidizable materials. In some embodiments, a through hole is formed on the fixed seat, and the driving end of the electric driving part 104 may move along the through hole.

As shown in FIG. 3, a through hole corresponding to the push plate 105 may be formed on the shell 1061 of the expansion tank, and the push plate 105 can pass through the through hole. The electric driving part 104 may be a member capable of extending or retracting the driving end. For example, as shown in FIG. 3, the electric driving part 104 comprises an electromagnet 1041. A controlled end of the electromagnet 1041 is powered on after receiving the driving electric signal, and a driving end of the electromagnet moves in the direction close to the expansion tank 106. The controlled end of the electromagnet 1041 may be powered off after receiving the reset electric signal, and the driving end of the electromagnet moves in the direction far away from the expansion tank. The push plate 105 presses or moves far away from the expansion tank 106 under the action of the electromagnet 1041.

Figure 4:
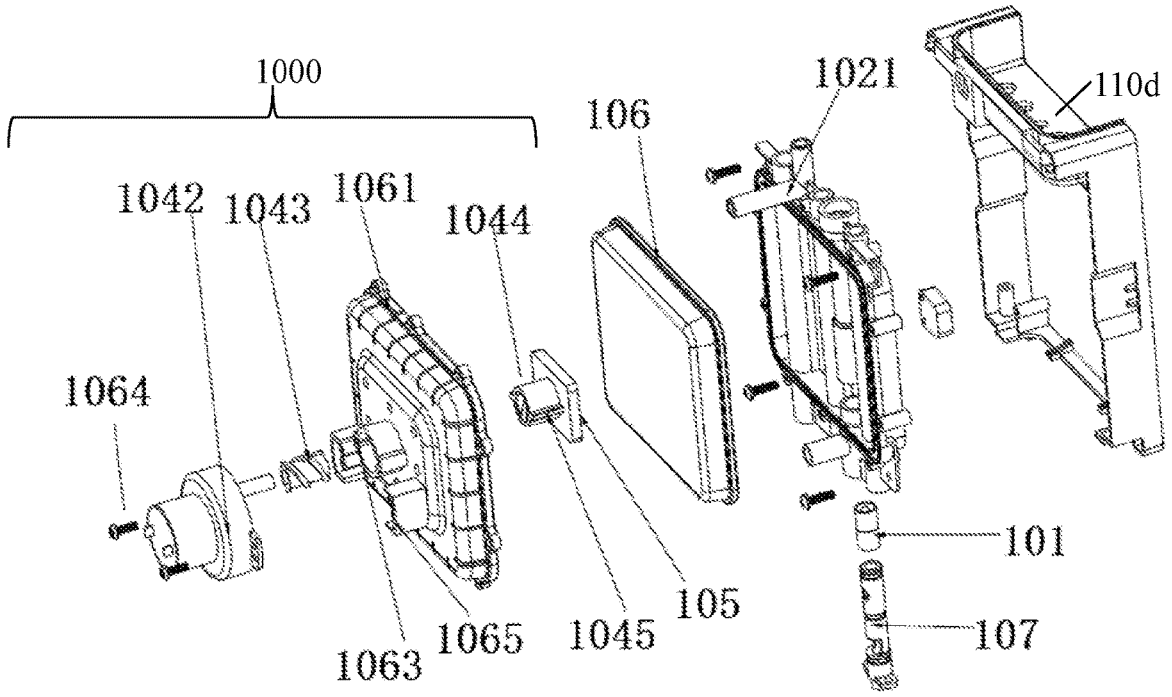
FIG. 4 is an exploded view of the expansion tank control device according to another embodiment of the disclosure.

Referring to FIG. 4, a chute 1063 is formed in the through hole; and an outer wall of the nut 1044 is formed with a rib 1045 matched with the chute 1063. The rib 1045 moves along the chute 1063 to ensure the stability of the push plate 105 in pushing and pressing the expansion tank 106. The expansion tank control device 1000 further comprises a fixing piece 1064. The fixed seat comprises a pair of fixing lugs 1065, and fixing holes are formed on the fixing lugs 1065. A connecting hole is formed on a shell of the electric driving part 104, and the fixing piece 1064 penetrates through the connecting hole and the fixing hole in turn to fix the electric driving part 104. In FIG. 4, the motor is fixed in the fixing hole with a screw, so as to improve the stability of the motor 1042 in the working process.

As shown in FIG. 4, the push plate 105 may be placed between the shell 1061 of the expansion tank and the expansion tank 106, the electric driving part 104 is arranged on the other side of the shell 1061 of the expansion tank, and the driving end of the electric driving part 104 may penetrate through the through hole, and the through hole is adapted to a shape of the driving end.

Figure 5:
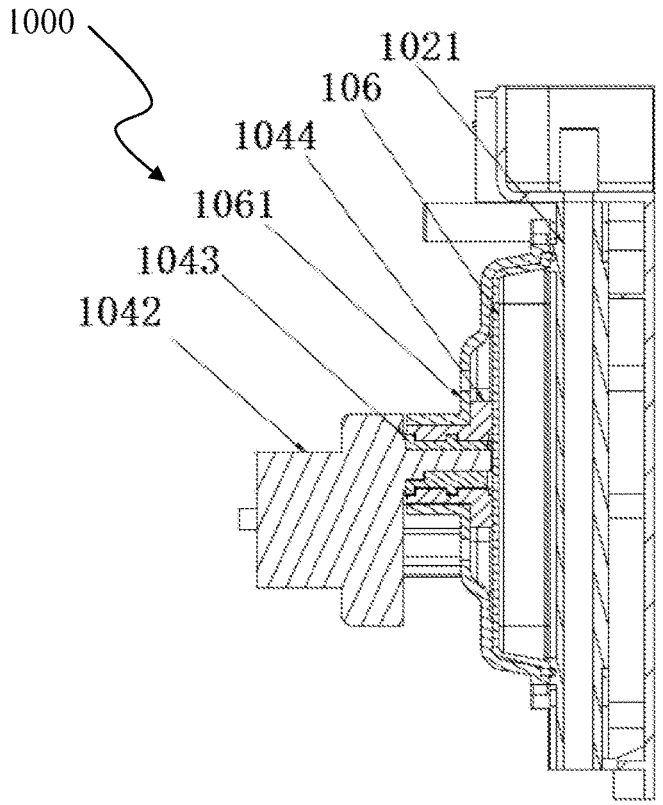
FIG. 5 is a side perspective view of the structure shown in FIG. 4 after assembly.

Referring now to FIG. 4 and FIG. 5, the electric driving part 104 comprises a motor 1042, a screw rod 1043, and a nut 1044 arranged in the through hole. The push plate 105 is connected with the nut 1044 and one end of the screw rod 1043 is connected with an output shaft of the motor 1042, and the other end of the screw rod 1043 is connected with the nut 1044. After receiving the driving electric signal, the controlled end of the motor 1042 drives the screw rod 1043 to rotate in a first direction (for example, clockwise), and the nut 1044 moves along the through hole in the direction close to the expansion tank 106. After receiving the reset electric signal, the controlled end of the motor 1042 drives the screw rod 1043 to rotate in a second direction (for example, anticlockwise), and the nut 1044 moves along the through hole in the direction far away from the expansion tank 106.

According to FIGS. 4 and 5, a structure such as a turbine worm may be used to facilitate the process in the embodiment above. A similar structure may be used according to another embodiment. In the above solution, the electric driving part 104 can be operated according to the control of the controller and is not affected by the water pressure, thus ensuring that the functions of the expansion tank 106 are not affected.

Figure 6:
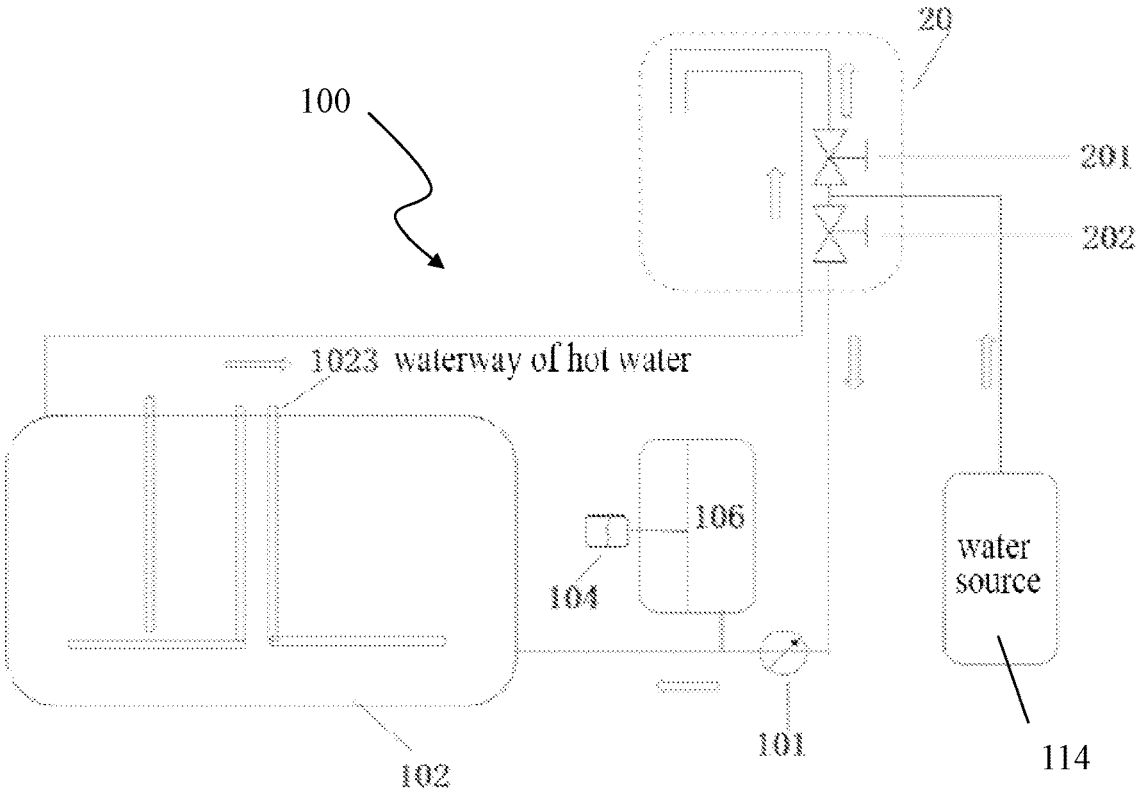
FIG. 6 is a block diagram of the water heater provided by the embodiment of the disclosure.

As shown in FIG. 6, some embodiments of the application provide a water heater assembly 100, wherein the water heater assembly 100 comprises the expansion tank control device 1000 described in any one of the above, and further comprises a faucet assembly 20, which comprises a cold water faucet 201 and a hot water faucet 202. When the hot water faucet 202 is turned on, the push plate 105 is driven to push and press the expansion tank 106 by using the signal of the water flow sensor so as to push out the stored water in the expansion tank 106; after the hot water faucet 202 is turned off, the signal of the water flow sensor indicates that there is no water flow, and the push plate 105 is driven to withdraw to suck the stored water in the heating tank 102 into the expansion tank 106, and form a cavity at the top of the heating tank 102 to absorb the volume expansion of the water during heating and prevent the hot water from flowing out from the water outlet of the faucet. The functions of the expansion tank 106 in this embodiment are not affected by tap water pressure, and are more reliable.

According to another embodiment of the expansion tank control device and the water heater comprising same, the water flow sensor may be used to detect whether a faucet is turned on. When the faucet is turned on, the water flow can be detected in the water inlet waterway of the water heater. The controller controls the electric driving part to drive the push plate to move in the direction towards the expansion tank so as to push out the water stored in the expansion tank. When the faucet is turned off, no water flow is detected in the water inlet waterway of the water heater. The controller then controls the electric driving part to drive the push plate to move in the direction away from the expansion tank so as to suck a portion of the water in the heating tank, into the expansion tank. This action may form a cavity at the top of the heating tank to absorb the volume expansion of the water in the heating process and prevent the hot water from flowing out from a water outlet of the faucet. Use of the electric driving part may result in more reliability, because the electric driving part is not influenced by water pressure.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

The invention claimed is:

1. An expansion tank control device, comprising:

a water flow sensor arranged in a water inlet waterway of a water heater, wherein the water flow sensor sends out a first electric signal after detecting a water flow in the water inlet waterway, and sends out a second electric signal after detecting that no water flow exists in the water inlet waterway;

a controller, wherein an input end of the controller is connected with an output end of the water flow sensor; and the controller outputs a driving electric signal after receiving the first electric signal output by the water flow sensor, and outputs a reset electric signal after receiving the second electric signal output by the water flow sensor; and an electric driving part arranged on a shell of an expansion tank, wherein a controlled end of the electric driving part is connected with an output end of the controller, and a driving end of the electric driving part is provided with a push plate; the controlled end of the electric driving part drives the push plate to move in a direction close to the expansion tank after receiving the driving electric signal; and the controlled end of the electric driving part drives the push plate to move in a direction far away from the expansion tank after receiving the reset electric signal.

2. The expansion tank control device of claim 1, further comprising:

a fixed seat arranged on the shell of the expansion tank, wherein the electric driving part is arranged on the fixed seat.

3. The expansion tank control device of claim 2, wherein a through hole is formed on the fixed seat, and the driving end of the electric driving part moves along the through hole.

4. The expansion tank control device of claim 3, wherein: the electric driving part comprises an electromagnet; and a controlled end of the electromagnet is powered on after receiving the driving electric signal, and a driving end of the electromagnet moves in the direction close to the expansion tank; and the controlled end of the electromagnet is powered off after receiving the reset electric signal, and the driving end of the electromagnet moves in the direction far away from the expansion tank.

5. The expansion tank control device of claim 3, wherein:

the electric driving part comprises a motor, a screw rod and a nut, and the nut is arranged in the through hole; the push plate is connected with the nut; one end of the screw rod is connected with an output shaft of the motor, and the other end of the screw rod is connected with the nut; and after receiving the driving electric signal, a controlled end of the motor drives the screw rod to rotate in a first direction, and the nut moves along the through hole in the direction close to the expansion tank; and after receiving the reset electric signal, the controlled end of the motor drives the screw rod to rotate in a second direction, and the nut moves along the through hole in the direction far away from the expansion tank.

6. The expansion tank control device of claim 5, wherein a chute is formed in the through hole; and an outer wall of the nut is formed with a rib matched with the chute.

7. The expansion control device of claim 6, wherein the rib moves along the chute to create stability of the push plate in pushing and pressing the expansion tank.

8. The expansion tank control device of claim 2, further comprising a fixing piece:

the fixed seat comprises a pair of fixing lugs, and fixing holes are formed on the fixing lugs; and a connecting hole is formed on a shell of the electric driving part, and the fixing piece penetrates through the connecting hole and the fixing hole in turn to fix the electric driving part.

9. The expansion tank control device of claim 2, further comprising a venturi pipe arranged on the water inlet waterway of the water heater and located at an opening of the expansion tank.

10. The expansion tank control device of claim 9, wherein the venturi pipe is arranged at a downstream position of the waterway of the water flow sensor and provides a supporting force for the water flow sensor.

11. A water heater, wherein the water heater comprises the expansion tank control device of claim 1.

12. The expansion control device of claim 1, wherein the electric driving part further comprises an electric cylinder, or an electric worm gear capable of extending or retracting the dividing end.

13. The expansion control device of claim 1, wherein the controller further comprises a control module of the water heater itself.

14. A method of using an expansion tank control device, the method comprising:

arranging a water flow sensor in a water inlet waterway of a water heater;

detecting water flow in the water inlet waterway using the water flow sensor;

sending a first electric signal after detecting water flow in the water inlet waterway;

sending a second electric signal after detecting that no water flow exists in the water inlet water way; and controlling an input end of a controller, wherein the controller is connected to an output end of the water flow sensor and outputs a driving signal after receiving the first electric signal output by the water flow sensor, and outputs a reset electric signal after receiving the second electric signal output by the water flow sensor.

15. The method of using an expansion control device of claim 14, the method further comprising:

arranging the water flow sensor at a front of an expansion tank.

16. A water heater for an expansion tank control device including an expansion tank, comprising:

a water inlet waterway;

a heating tank;

a venturi pipe arranged on the water inlet waterway, within an opening of the expansion tank; and one or more water flow sensors, wherein the one or more water flow sensors is arranged between a water source and a heating tank, and the one or more water flow sensors further comprises a water pressure sensor or a conductivity sensor, wherein the one or more water flow sensors sends out a first electric signal after detecting a water flow in the water inlet waterway, and wherein the one or more water flow sensors sends out a second electric signal after detecting that no water flow exists in the inlet waterway.

17. The water heater of claim 16, wherein an inlet hose and a drain pipe are stored in the expansion tank.

18. The water heater of claim 16, wherein the one or more water flow sensors are arranged at the front of the expansion tank, and upon receiving a detected signal from the one or more water flow sensors, water is released from the heating tank to the expansion tank.

19. A water heater for an expansion tank control device including an expansion device, comprising:

a water inlet waterway;

a heating tank;

a venturi pipe arranged on the water inlet waterway, within an opening of the expansion tank control device; and one or more water flow sensors, wherein the one or more water flow sensors is arranged between a water source and a heating tank, and the water flow sensor further comprises a water pressure sensor or a conductivity sensor, wherein the one or more flow sensors is arranged between a water source and a heating tank and at the front of the expansion tank, and the water flow sensor further comprises a water pressure sensor or a conductivity sensor, and wherein upon receiving a detected signal from the one or more flow sensors, water is released from the heating tank to the expansion tank.

20. The water heater of claim 19, wherein the one or more water flow sensors sends out a first electric signal after detecting a water flow in the water inlet waterway.

21. The water heater of claim 20, wherein the one or more water flow sensors sends out a second electric signal after detecting that no water flow exists in the inlet waterway.

22. The water heater of claim 19, wherein an inlet hose and a drain pipe are stored in the expansion tank.

* * * * *